US009869099B2

(12) United States Patent
Qu et al.

(10) Patent No.: US 9,869,099 B2
(45) Date of Patent: Jan. 16, 2018

(54) OUTDOOR FLOORING AND MANUFACTURING METHOD THEREOF

(71) Applicant: SHANGHAI HAIXING PLASTIC INDUSTRY CO., LTD., Shanghai (CN)

(72) Inventors: Xuesong Qu, Jiangsu (CN); Jun Wang, Jiangsu (CN)

(73) Assignee: SHANGHAI HAIXING PLASTIC INDUSTRY CO., LTD., Shanghai (CN)

( * ) Notice: Subject to any disclaimer, the term of this patent is extended or adjusted under 35 U.S.C. 154(b) by 0 days.

(21) Appl. No.: 15/089,555

(22) Filed: Apr. 3, 2016

(65) Prior Publication Data

US 2017/0218639 A1 Aug. 3, 2017

(30) Foreign Application Priority Data

Feb. 1, 2016 (CN) ..... 2016 1 0070813

(51) Int. Cl.
*E04F 15/02* (2006.01)
*E01C 11/16* (2006.01)
*E01C 5/22* (2006.01)

(52) U.S. Cl.
CPC ..... *E04F 15/02183* (2013.01); *E01C 5/22* (2013.01); *E01C 11/16* (2013.01); *E04F 15/02038* (2013.01); *E04F 15/02172* (2013.01)

(58) Field of Classification Search
CPC ..... E01C 5/22; E01C 11/16; E04F 15/02183; E04F 15/02038; E04F 15/02172
See application file for complete search history.

(56) References Cited

U.S. PATENT DOCUMENTS 1,645,635 A * 10/1927 Wescott ..... E01C 5/18 220/DIG. 12
1,885,720 A * 11/1932 Hewett ..... B28B 7/0044 404/44
1,925,460 A * 9/1933 Pegram ..... B28B 19/0053 156/297
2,041,032 A * 5/1936 Van Der Pyl ..... E01C 5/18 404/21
2,176,849 A * 10/1939 Schmeller, Sr. ..... E04F 11/16 164/110
2,294,582 A * 9/1942 Sullivan ..... E01C 5/22 404/21
3,246,058 A * 4/1966 Voelker ..... B29C 44/30 156/152
3,344,011 A * 9/1967 Goozner ..... B29D 99/0057 156/242
6,309,562 B1 * 10/2001 Sakai ..... C04B 20/1055 252/301.21
2002/0043047 A1 * 4/2002 Placuzzi ..... E01C 5/22 52/796.1
2002/0192431 A1 * 12/2002 Edgman ..... B27N 3/28 428/181
2003/0012600 A1 * 1/2003 Kaneko ..... E01C 5/22 404/32

(Continued)

*Primary Examiner* — Abigail A Risic

(57) ABSTRACT

An outdoor flooring and a manufacturing method thereof, the outdoor flooring includes a metal core and a basal layer, and the metal core is disposed within the basal layer. The outdoor flooring is mainly used as a building material in outdoor public places, such as gardens, pavilions, lakes, seas and holiday villages.

12 Claims, 2 Drawing Sheets

(56) References Cited

U.S. PATENT DOCUMENTS

| | | | | |
|---|---|---|---|---|
| 2003/0087074 | A1* | 5/2003 | Yamanashi | C04B 26/06 428/212 |
| 2004/0048025 | A1* | 3/2004 | Lohnes | B29C 67/243 428/40.1 |
| 2006/0251862 | A1* | 11/2006 | Sievers | E01C 5/22 428/172 |
| 2007/0042828 | A1* | 2/2007 | Krushke, Jr. | B32B 5/18 472/92 |
| 2013/0227904 | A1* | 9/2013 | Amend | E04C 2/26 52/309.11 |
| 2013/0260075 | A1* | 10/2013 | Dust | B28B 23/0075 428/51 |
| 2014/0227484 | A1* | 8/2014 | Sung | B32B 27/12 428/147 |
| 2015/0114552 | A1* | 4/2015 | Cernohous | C08J 5/00 156/242 |

* cited by examiner

OUTDOOR FLOORING AND MANUFACTURING METHOD THEREOF

CROSS-REFERENCE TO RELATED APPLICATIONS

The present application claims the benefit of Chinese Patent Application No. 201610070813.7 filed on Feb. 1, 2016, the contents of which are hereby incorporated by reference.

TECHNICAL FIELD

The invention relates to a flooring and a manufacturing method thereof, specifically an outdoor flooring and a manufacturing method thereof, and belongs to the field of building materials.

BACKGROUND

At present, the outdoor flooring is mainly applied in public places such as gardens, pavilions, lakes, seas and holiday villages. Because the outdoor flooring is exposed to sunlight and rainwater, as well as strong temperature difference for a long time, the outdoor flooring must possess characteristics such as strong stability, strong corrosion resistance, and strong compression resistance, which solves requirements of permanence and environmental protection for the outdoor flooring in a special environment. Now the outdoor flooring mainly includes wood-plastic outdoor flooring, anticorrosive-wood outdoor flooring, carbonized-wood outdoor flooring, co-extruded wood-plastic outdoor flooring, but above floorings have undesirable slip resistance and compression resistance, and a large expansion coefficient.

SUMMARY OF THE INVENTION

The present invention aims to solve disadvantages of the prior art above, and provides an outdoor flooring with excellent slip resistance, excellent compression resistance and low expansion coefficient.

The outdoor flooring of the present invention includes a metal core, a basal layer and a surface layer, said metal core is disposed within the basal layer, said surface layer covers the basal layer, and raw materials for preparing said surface layer include any one of elastomeric material or ASA.

In order to further solve above problems, said metal core is a planar structure or its cross section is a zigzag structure, and the metal core is provided with a punched hole.

In order to further solve above problems, said surface layer is provided with noctilucent stripes thereon, raw materials for preparing said noctilucent stripes include noctilucent powder or mixture of noctilucent powder and pigment.

In order to further solve above problems, raw materials for preparing said basal layer include plastic, bulking agent and auxiliary agent.

In order to further solve above problems, said plastic is any one of PE, PVC or PS.

In order to further solve above problems, said elastomeric material includes any one or mixture of more of flexible PVC, rubber, TPE or TPU.

In order to further solve above problems, said surface layer is provided with embossed patterns thereon.

Another aspect of the invention provides a method of manufacturing the outdoor flooring, comprising the following steps:

(1) preparing a metal core;

(2) respectively formulating the raw materials of the basal layer and the raw materials of the surface layer, and adding noctilucent powder or mixture of noctilucent powder and pigment to the raw material of the surface layer;

(3) mixing the raw materials of the basal layer and the raw materials of the surface layer described above respectively by utilizing a mixer;

(4) placing the metal core in a mould, extruding the raw materials of the basal layer and the raw materials of the surface layer described above by a plastic extruder, and cooling down to shape on the mould with the metal core placed thereon;

(5) cutting into a proper size as required; and (6) embossing on the surface layer by an embosser.

In order to further solve above problems, step (1) comprises: preparing a metal core such that the cross section of said metal core has a zigzag structure, and punching holes in the metal core In order to further solve above problems, step (2) comprises: formulating the raw materials of the basal layer by utilizing a mixture of plastic, auxiliary agent and bulking agent, while formulating the raw materials of the surface layer by utilizing elastomeric material or ASA.

In order to further solve above problems, in said step (2), the plastic for formulating the raw materials of the basal layer is any one material of PE, PVC or PS; said elastomeric material for formulating the raw materials of the surface layer is any one material or mixture of more materials of flexible PVC, rubber, TPE or TPU.

The surface layer of said outdoor flooring of the invention prepared with the elastomeric material has a bigger frictional coefficient and produces an excellent anti-skidding effect; addition of the metal core also improves compression resistance of the flooring, meanwhile reduces the expansion coefficient, and will hardly deform; patterns prepared with the noctilucent powder is irradiated by sunlight in the day time, stores heat, glows in the night and plays an indication function.

DETAILED DESCRIPTION OF THE PREFERRED EMBODIMENT

In order to further understand the invention, the invention will be further described in detail in conjunction with examples and drawings, and the examples are only used to explain the invention, and do not constitute limitation on the protection scope of the invention.

Figure 1:
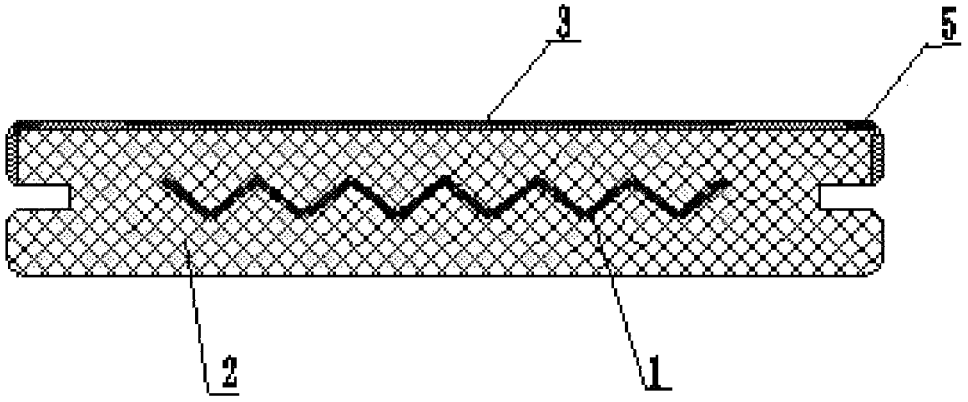
FIG. 1 is an overall structural schematic diagram of the first specific embodiment of the invention.
Figure 3:
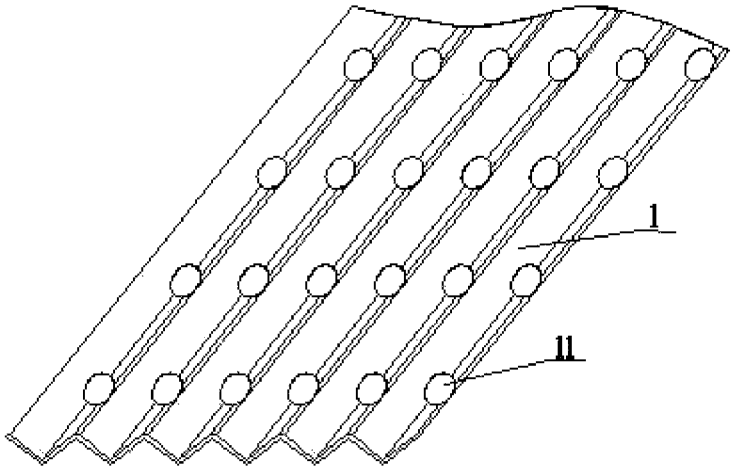
FIG. 3 is a structural schematic diagram of the metal core of the invention.

Referring to FIGS. 1 and 3, in Example 1 the invention discloses an outdoor flooring, including a metal core 1 and a basal layer 2, wherein said metal core 1 is disposed within the basal layer 2. The metal core 1 is generally made of common metal materials such as iron, aluminum or alloy, normally set to be a planar structure or similar to a planar structure, and mainly plays a supporting role, and the cross section employed in this Example is a zigzag structure. The metal core 1 can also be provided with a punched hole 11.

The raw materials for preparing the basal layer 2 described above include plastic, auxiliary agent and bulking agent, the plastic is any one of PE, PVC or PS, the bulking agent employed in this Example is the mixture of both wood flour and calcium carbonate, and can also be a certain substance alone, and the bulking agent is the auxiliary agent commonly used in current plastic production process, such as lubricant, and is also well-known to those skilled in the art.

In order to further optimize the design scheme, the outdoor flooring in this Example also includes a surface layer 3, and the surface layer 3 covers the basal layer 2, can enwrap the whole basal layer 2, or can only enwrap one surface of the basal layer 2, and only enwraps the upper surface of the basal layer 2 alone in this Example. The raw materials for preparing the surface layer 3 mainly include any one of elastomeric material or ASA, said elastomeric material includes any one or mixture of more of flexible PVC, rubber, TPE or TPU, produces an excellent anti-skidding effect, and in this Example is mainly made from flexible PVC and rubber.

In order to further optimize the design scheme, the surface layer 3 is provided with noctilucent stripes 5 thereon, which mainly plays an indicating role in the night; raw materials for preparing the noctilucent stripes 5 are mainly noctilucent powder, of course pigment can also be added into the noctilucent powder to prepare a mixture, the pigment can be fluorescent pigment, and in this way color can change. The surface layer 3 can also be provided with embossed patterns thereon, which produces a beautiful effect. Of course, shapes of the noctilucent stripes 5 and the embossed patterns are not restricted, and in this Example, said noctilucent stripes 5 are lines provided on both sides of the surface layer 3. The whole lateral surface of the outdoor flooring is provided with a connecting groove.

Example 2 Outdoor Flooring

Figure 2:
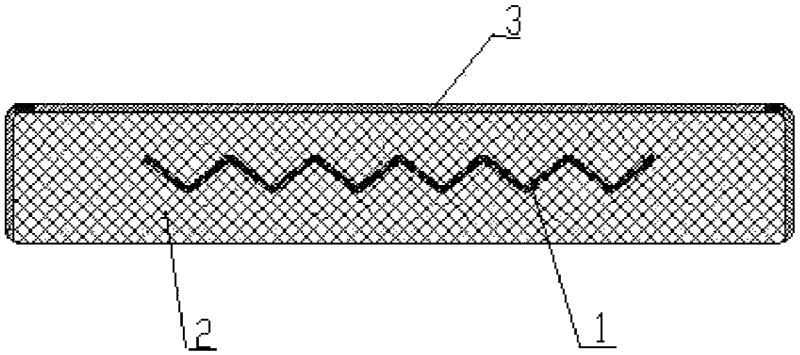
FIG. 2 is an overall structural schematic diagram of the second specific embodiment of the invention.

Referring to FIG. 2, this Example 2 has a basic structure same as in Example 1, including a metal core 1, a basal layer 2 and a surface layer 3, and the only difference is that the surface layer 3 covers the upper surface and the lateral surface of the basal layer, and no connecting groove is provided on the lateral part of the basal layer 2.

Example 3 The Method of Manufacturing the Outdoor Flooring in Example 1 Described Above, Comprises the Following Steps (1) preparing a metal core such that its cross section has a zigzag structure, and punching holes in the metal core;

(2) formulating the raw materials of the basal layer by utilizing a mixture of PVC, auxiliary agent, calcium carbonate and wood flour, formulating the raw materials of the surface layer by utilizing flexible PVC and rubber, and adding noctilucent powder and fluorescent pigment into the raw materials of the surface layer;

(3) mixing the raw materials of the basal layer and the raw materials of the surface layer described above by utilizing a mixer;

(4) placing the metal core in a mould, extruding the raw materials of the basal layer and the raw materials of the surface layer described above by a plastic extruder, and cooling down to shape on the mould with the metal core placed thereon;

(5) cutting into a proper size as required; and (6) embossing on the surface layer by an embosser.

The extruder, mixer and embosser described above are machines routinely used in the art, and are well-known to those skilled in the art.

Facts proved that the outdoor flooring prepared in above examples is durable in use, has greatly improved slip resistance than common outdoor flooring, is almost not deformed, and has better compression resistance than common co-extruded flooring.

The foregoing is only preferred examples of the invention, and not used to limit the invention, and any modification, equivalent replacement, improvement, etc. made within the spirit and principle of the invention shall be included within the protection scope of the invention.

What is claimed is:

1. An outdoor flooring comprising a metal core, a basal layer and a surface layer, wherein the basal layer comprises an upper surface and a lateral surface, the lateral surface of the basal layer is provided with a connecting groove the metal core is disposed within the basal layer, the surface layer covers the upper surface of the basal layer and a portion of the lateral surface of the basal layer in between the upper surface and the connecting groove, and raw materials for preparing the surface layer include any one of elastomeric material or ASA.

2. The outdoor flooring according to claim 1, wherein the metal core is a planar structure or its cross section is a zigzag structure, and the metal core is provided with punched holes.

3. The outdoor flooring according to claim 1, wherein the surface layer is provided with noctilucent stripes thereon, the raw materials for preparing the noctilucent stripes include noctilucent powder or mixture of noctilucent powder and pigment.

4. The outdoor flooring according to claim 1, wherein the raw materials for preparing the basal layer include plastic, bulking agent and auxiliary agent.

5. The outdoor flooring according to claim 4, wherein the plastic is any one of PE, PVC or PS.

6. The outdoor flooring according to claim 1, wherein the elastomeric material includes any one or mixture of more materials of flexible PVC, rubber, TPE or TPU.

7. The outdoor flooring according to claim 1, wherein the surface layer is provided with embossed patterns thereon.

8. A method of manufacturing the outdoor flooring according to claim 1, comprising the following steps:

(1) preparing a metal core;

(2) respectively formulating the raw materials of the basal layer and the raw materials of the surface layer, and adding noctilucent powder or mixture of noctilucent powder and pigment to the raw material of the surface layer;

(3) mixing the raw materials of the basal layer and the raw materials of the surface layer described above respectively by utilizing a mixer;

(4) placing the metal core in a mould, extruding the raw materials of the basal layer and the raw materials of the surface layer described above by a plastic extruder, and cooling down to shape on the mould with the metal core placed thereon;

(5) cutting into a proper size as required; and (6) embossing on the surface layer by an embosser.

9. The method according to claim 8, wherein:

step (1) comprises: preparing a metal core such that the cross section of the metal core has a zigzag structure, and punching holes in the metal core.

10. The method according to claim 8, wherein:

step (2) comprises: formulating the raw materials of the basal layer by utilizing a mixture of plastic, auxiliary agent and bulking agent, and formulating the raw materials of the surface layer by utilizing elastomeric material or ASA.

11. The method according to claim 10, wherein:

in step (2), the plastic for formulating the raw materials of the basal layer is any one material of PE, PVC or PS; the elastomeric material for formulating the raw materials of the surface layer is any one material or mixture of more materials of flexible PVC, rubber, TPE or TPU.

12. The outdoor flooring according to claim 1, wherein the metal core is not in contact with the surface layer.

* * * * *